US008620560B2

(12) United States Patent
Imai et al.

(10) Patent No.: US 8,620,560 B2
(45) Date of Patent: Dec. 31, 2013

(54) INTERNAL COMBUSTION ENGINE CONTROL DEVICE

(75) Inventors: Yasuhito Imai, Toyota (JP); Ryuji Okamura, Toyota (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 189 days.

(21) Appl. No.: 13/145,380

(22) PCT Filed: Mar. 23, 2010

(86) PCT No.: PCT/JP2010/054972

§ 371 (c)(1), (2), (4) Date: Jul. 20, 2011

(87) PCT Pub. No.: WO2011/117969

PCT Pub. Date: Sep. 29, 2011

(65) Prior Publication Data

US 2012/0035826 A1 Feb. 9, 2012

(51) Int. Cl.
*F01P 7/00* (2006.01)
*F01P 7/02* (2006.01)

(52) U.S. Cl.
USPC ..... 701/102; 123/480; 123/90.19

(58) Field of Classification Search
USPC ..... 701/102, 29.2, 114; 123/480, 90.19, 123/90.11
See application file for complete search history.

(56) References Cited

U.S. PATENT DOCUMENTS 6,088,631 A * 7/2000 Kuehn et al. ..... 701/1
6,138,636 A 10/2000 Kohno et al.
6,655,326 B2 * 12/2003 Purcell et al. ..... 123/41.31
7,240,660 B1 * 7/2007 Bryant et al. ..... 123/299
2001/0015181 A1 8/2001 Purcell et al.
2001/0032604 A1 10/2001 Nishida et al.
2007/0250250 A1 10/2007 Yoshioka et al.

FOREIGN PATENT DOCUMENTS

DE 197 12 445 10/1998
DE 198 60 762 7/2000
DE 101 17 688 10/2001
DE 10 2005 021 490 11/2006
DE 600 28 713 11/2006
DE 10 2007 044 224 4/2008
EP 2484885 A1 * 8/2012
JP 10-166965 6/1998

(Continued)

*Primary Examiner* — Mahmoud Gimie
(74) *Attorney, Agent, or Firm* — Finnegan, Henderson, Farabow, Garrett & Dunner, LLP

(57) ABSTRACT

The invention aims at providing an internal combustion engine control device 1 which can make suppression of a rise in the temperature of an engine control ECU 2, and fuel cut control of an engine compatible with each other. An internal combustion engine control device 1, which controls an engine having a plurality of cylinders having intake valves and exhaust valves, includes intake valve solenoids 8 to 11 and exhaust valve solenoids 12 to 15 which switch the operating state of valve elements of the intake valves or exhaust valves to a drive state and a closed valve holding state; an engine control ECU 2 which controls the intake valve solenoids 8 to 11 and the exhaust valve solenoids 12 to 15; an ECU temperature sensor 6 which detects the temperature of the engine control ECU 2; and a switching number setting unit 32 which sets the number of valve elements whose operating state is switched at one time by the intake valve solenoids 8 to 11 and the exhaust valve solenoids 12 to 15 to be smaller, as the temperature detected by the ECU temperature sensor 6 is higher.

2 Claims, 4 Drawing Sheets

(56) References Cited

FOREIGN PATENT DOCUMENTS

| | | |
|---|---|---|
| JP | 11-336577 | 12/1999 |
| JP | 2000-73834 | 3/2000 |
| JP | 2001-115864 | 4/2001 |
| JP | 2001-289076 | 10/2001 |
| JP | 2001-289091 | 10/2001 |
| JP | 2004-257339 | 9/2004 |
| JP | 2006-112414 | 4/2006 |
| JP | 2007-231872 | 9/2007 |
| JP | 2008-291692 | 12/2008 |

* cited by examiner

INTERNAL COMBUSTION ENGINE CONTROL DEVICE

TECHNICAL FIELD

The present invention relates to an internal combustion engine control device which controls an internal combustion engine.

BACKGROUND ART

In the related art, Japanese Unexamined Patent Application Publication No. 10-166965 is an example of the technique literature of this field. In an electronic control device for a vehicle described in this publication, occurrence of a failure caused by a rise in the temperature of the electronic control device is prevented by compulsorily turning off a transistor which controls energization, when the temperature of the electronic control device is equal to or higher than a predetermined temperature.

CITATION LIST

Patent Literature

Patent Literature 1: Japanese Unexamined Patent Application Publication No. 10-166965

SUMMARY OF INVENTION

Technical Problem

Meanwhile, in the control of an internal combustion engine of a vehicle, the control of respective elements, such as injectors, intake valves, exhaust valves, and igniters, is intricately related. For this reason, if there is provided a configuration in which energization is cut off when the temperature of the electronic control device is equal to or higher than a predetermined temperature as in the aforementioned electronic control device, there is a possibility that the running control of an internal combustion engine, such as fuel cut control, may be hindered, and failure or degradation of fuel consumption may be caused.

The object of the invention is to provide an internal combustion engine control device which can make the number of valve elements whose operating state is switched at one time by switching units smaller as the temperature of a control unit is higher, thereby making suppression of a rise in the temperature of the control unit, and fuel cut control of an internal combustion engine compatible with each other.

Solution to Problem

In order to solve the above problem, the invention provides an internal combustion engine control device which controls an internal combustion engine having a plurality of cylinders having intake valves and exhaust valves. The internal combustion engine control device includes switching units which switch the operating state of valve elements of the intake valves or exhaust valves to a drive state and a closed valve holding state; a control unit which controls the switching units; a temperature detecting unit which detects the temperature of the control unit; and a switching number setting unit which sets the number of valve elements whose operating state is switched at one time by the switching units to be smaller, as the temperature detected by the temperature detecting unit is higher.

According to the internal combustion engine control device related to the invention, since the number of valve elements whose operating state is switched at one time by the switching units becomes smaller as the temperature of the control unit becomes a higher temperature, the electric load applied to the control unit by one switching can be reduced. As a result, since the amount of heat generation of the control unit produced by one switching becomes small, a rise in the temperature of the control unit can be suppressed. Moreover, in this internal combustion engine control device, a rise in the temperature of the control unit is suppressed by making the number of valve elements whose operating state is switched at one time small. Thus, realization of the fuel cut control of switching fuel supply stop to the cylinders and switching of the operating state of the valve elements of the cylinders is not hindered. Accordingly, according to this internal combustion engine control device, suppression of a rise in the temperature of the control unit and the fuel cut control of the internal combustion engine can be made compatible with each other.

In the internal combustion engine control device related to the invention, it is preferable that, when the number of valve elements set by the switching number setting unit is equal to or more than the number of the intake valves of all the cylinders, the control unit controls the switching units such that the operating state of the valve elements of the intake valves of all the cylinders are switched at one time.

In this case, since the operating state of the valve elements of the intake valves of all the cylinders is preferentially switched at one time, it is possible to avoid cases where unnecessary air enters the cylinders at the start of the fuel cut control from the intake valves of which the closing is delayed. This improves the execution frequency of instant implementation of the fuel cut control of performing switching of the operating state of the valve elements of the intake valves of all the cylinders and the fuel supply stop of all the cylinders at one time. Accordingly, according to this internal combustion engine control device, improvement in the fuel consumption of the internal combustion engine can be achieved by improving the execution frequency of instant implementation of the fuel cut control.

Advantageous Effects of Invention

According to the invention, suppression of a rise in the temperature of the control unit and the fuel cut control of the internal combustion engine can be made compatible with each other.

DESCRIPTION OF EMBODIMENTS

Figure 1:
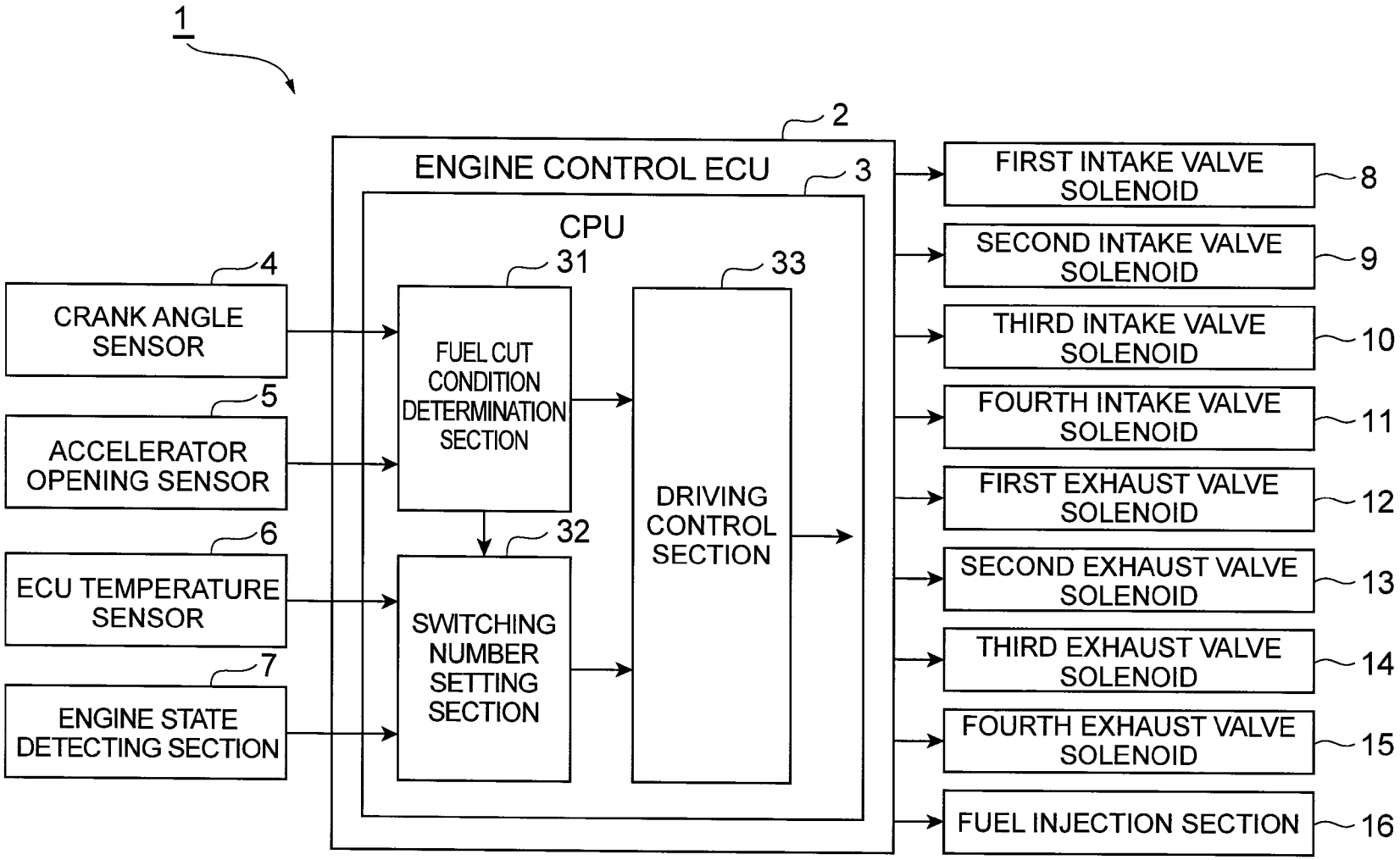
FIG. 1 is a block diagram showing an internal combustion engine control device related to a first embodiment.

Hereinafter, preferred embodiments of the invention will be described in detail with reference to the drawings. In addition, in respective drawings, the same reference numerals will be given to the same or equivalent portions, and duplicate description will be omitted.

First Embodiment

An internal combustion engine control device 1 related to a first embodiment controls a 4-cylinder reciprocating engine (internal combustion engine) provided in a vehicle. The internal combustion engine control device 1 carries out the fuel cut control of stopping fuel supply of all 4 cylinders, when predetermined fuel cut conditions are satisfied. The reciprocating engine controlled by the internal combustion engine control device 1 includes a variable valve mechanism which makes the opening and closing timing or the lift amount of the intake valves and exhaust valves of the cylinders variable, and an EGR (Exhaust Gas Recirculation) which returns a portion of the exhaust gas discharged from the cylinders to an air intake side.

As shown in FIG. 1, the internal combustion engine control device 1 includes an engine ECU (Electronic Control Unit) 2 which performs integrated control of the device. The engine control ECU 2 is an electronic control unit having a CPU (Central Processing Unit) 3 which performs arithmetic processing. The engine control ECU 2 functions as a control unit set forth in the claims.

The engine control ECU 2 is electrically connected to a crank angle sensor 4, an accelerator opening sensor 5, an ECU temperature sensor 6, and an engine state detecting section 7. Additionally, the engine control ECU 2 is electrically connected to intake valve solenoids 8 to 11, exhaust valve solenoids 12 to 15, and a fuel injection section 16.

The crank angle sensor 4 detects the rotational angle of a crankshaft of the internal combustion engine. The crank angle sensor 4 outputs a crank angle signal according to the detected rotational angle of the crankshaft to the engine control ECU 2. The accelerator opening sensor 5 detects, the opening, i.e., operation amount, of an accelerator operating part of the vehicle by a driver. The accelerator opening sensor 5 outputs an accelerator opening signal according to the detected opening of the accelerator operating part to the engine control ECU 2.

The ECU temperature sensor 6 detects the temperature of the engine control ECU 2. The ECU temperature sensor 6 outputs an ECU temperature signal according to the detected temperature of the engine control ECU 2 to the engine control ECU 2. The ECU temperature sensor 6 functions as a temperature detecting unit set forth in the claims.

The engine state detecting section 7 detects the operating state of the engine. The engine state detecting section 7 outputs an engine state signal according to the detected operating state of the engine to the engine control ECU 2.

The intake valve solenoids 8 to 11 and the exhaust valve solenoids 12 to 15 are actuators which switch the operating state of valve elements of the intake valves or valve elements of the exhaust valves, according to an electric command signal from the engine control ECU 2. Specifically, the intake valve solenoids 8 to 11 and the exhaust valve solenoids 12 to 15 switch the operating state of the valve elements to a drive state and a closed valve holding state. Here, the drive state is a state where a valve element repeats the opening and closing operation of an intake valve or an exhaust valve. The closed valve holding state is a state where a valve element is held at a position where the valve element closes an intake valve or an exhaust valve.

The intake valve solenoids 8 to 11 and the exhaust valve solenoids 12 to 15 structurally separate the interlocking between the cam shaft of the engine and the valve elements, thereby switching the operating state of the valve elements to a drive state and a closed valve element holding state. The intake valve solenoids 8 to 11 and the exhaust valve solenoids 12 to 15 switch the operating state of the valve elements, according to a signal from the engine control ECU 2.

The intake valve solenoids 8 to 11 are composed of four solenoids of a first intake valve solenoid 8, a second intake valve solenoid 9, a third intake valve solenoid 10, and a fourth intake valve solenoid 11. The first intake valve solenoid 8, the second intake valve solenoid 9, the third intake valve solenoid 10, and the fourth intake valve solenoid 11 correspond to the valve elements of the intake valves of the four cylinders, respectively.

Additionally, the exhaust valve solenoids 12 to 15 are composed of four solenoids of a first exhaust valve solenoid 12, a second exhaust valve solenoid 13, a third exhaust valve solenoid 14, and a fourth exhaust valve solenoid 15. The first exhaust valve solenoid 12, the second exhaust valve solenoid 13, the third exhaust valve solenoid 14, and the fourth exhaust valve solenoid 15 correspond to the valve elements of the exhaust valves of the four cylinders, respectively. The intake valve solenoids 8 to 11 and the exhaust valve solenoids 12 to 15 function as switching units set forth in the claims.

The fuel injection section 16 includes four electronic control injectors corresponding to the four cylinders, respectively. The fuel injection section 16 injects fuel from each injector, thereby supplying the fuel into a cylinder. The fuel injection section 16 controls the fuel injection or injection stop of each injector, according to a signal from engine control ECU 2.

The CPU 3 of the engine control ECU 2 has a fuel cut condition determination section 31, a switching number setting section 32, and a driving control section 33. The fuel cut condition determination section 31 determines whether or not predetermined fuel cut conditions are satisfied on the basis of the crank angle signal of the crank angle sensor 4 and the accelerator opening signal of the accelerator opening sensor 5. Such fuel cut conditions include the conditions satisfied when the rotational frequency of the engine is equal to or more than a predetermined rotational frequency, and a throttle valve of the engine is closed. Additionally, the fuel cut condition determination section 31 determines whether or not the fuel cut conditions become not satisfied, after the satisfaction of the fuel cut conditions.

The switching number setting section 32 performs the switching number setting processing of setting the number of valve elements whose operating state is switched at one time by the intake valve solenoids 8 to 11 and the exhaust valve solenoids 12 to 15, when the fuel cut condition determination section 31 determines that the fuel cut conditions have been satisfied. The switching number setting section 32 sets the number of valve elements whose operating state is switched at one time, on the basis of the ECU temperature signal of the ECU temperature sensor 6 and the engine state signal of the engine state detecting section 7.

The switching number setting section 32 sets the number of valve elements in units of two such that the operating states of valve elements of the intake valve and exhaust valve of one cylinder are switched at one time. The switching number setting section 32 sets the number of valve elements whose operating state is switched at one time to be smaller, as the temperature of the engine control ECU 2 recognized from the ECU temperature signal of the ECU temperature sensor 6 is higher.

Specifically, the switching number setting section 32 recognizes the temperature of the engine control ECU 2 from the ECU temperature signal. The switching number setting section 32 determines whether or not the recognized temperature of the engine control ECU 2 is lower than a predetermined normal temperature. The switching number setting section 32 sets the number of valve elements whose operating state is switched at one time in units of eight (the number of valve elements of all intake valves and exhaust valves of 4 cylinders), when it is determined that the temperature of the engine control ECU 2 is lower than a predetermined normal temperature. The switching number setting section 32 sets the number of valve elements whose operating state is switched at one time in units of four (the number of valve elements of intake valves and exhaust valves of 2 cylinders), when it is determined that the temperature of the engine control ECU 2 is equal to or higher than a predetermined normal temperature.

Additionally, the switching number setting section 32 sets the number of valve elements whose operating state is switched at one time to be smaller, when it is determined that the load applied to the engine control ECU 2 increases in a predetermined time, on the basis of an engine state recognized from an engine state signal. The switching number setting section 32 functions as a switching number setting unit set forth in the claims.

The driving control section 33 drives the intake valve solenoids 8 to 11 and the exhaust valve solenoids 12 to 15, when the switching number setting section 32 sets the number of valve elements whose operating state is switched at one time. The driving control section 33 performs the switching processing of driving the same number of solenoids as that set in the switching number setting processing out of the intake valve solenoids 8 to 11 and the exhaust valve solenoids 12 to 15, thereby switching the operating state of the same number of valve elements from a drive state to a closed valve holding state at one time. The driving control section 33 switches simultaneously the operating state of valve elements of an intake valve and an exhaust valve corresponding to one cylinder.

The driving control section 33 repeats the switching processing a required number of times, thereby switching the operating state of all the valve elements. In addition, the time until the next switching is performed after the operating state of a valve element is switched once is appropriately set in consideration of the initiation speed of the fuel cut control or the electric load applied to the engine control ECU 2. When the operating state of all the valve elements is switched to a closed valve holding state, the driving control section 33 controls the fuel injection section 16 to perform the fuel supply stop processing of stopping supply of fuel, thereby implementing fuel cut control. The driving control section 33 ends the fuel cut control, when the fuel cut condition determination section 31 has determined whether or not the fuel cut conditions have become not satisfied.

Next, the fuel cut control of the internal combustion engine control device 1 related to the first embodiment will be described with reference to FIG. 2.

Figure 2:
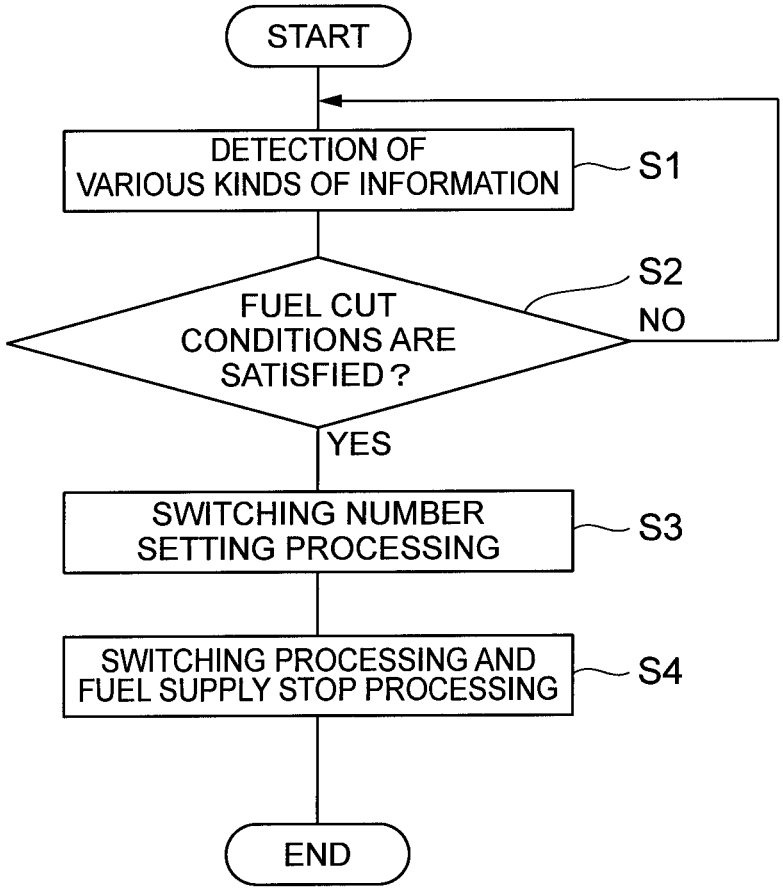
FIG. 2 is a flow chart showing fuel cut control of the internal combustion engine control device related to the first embodiment.
Figure 3:
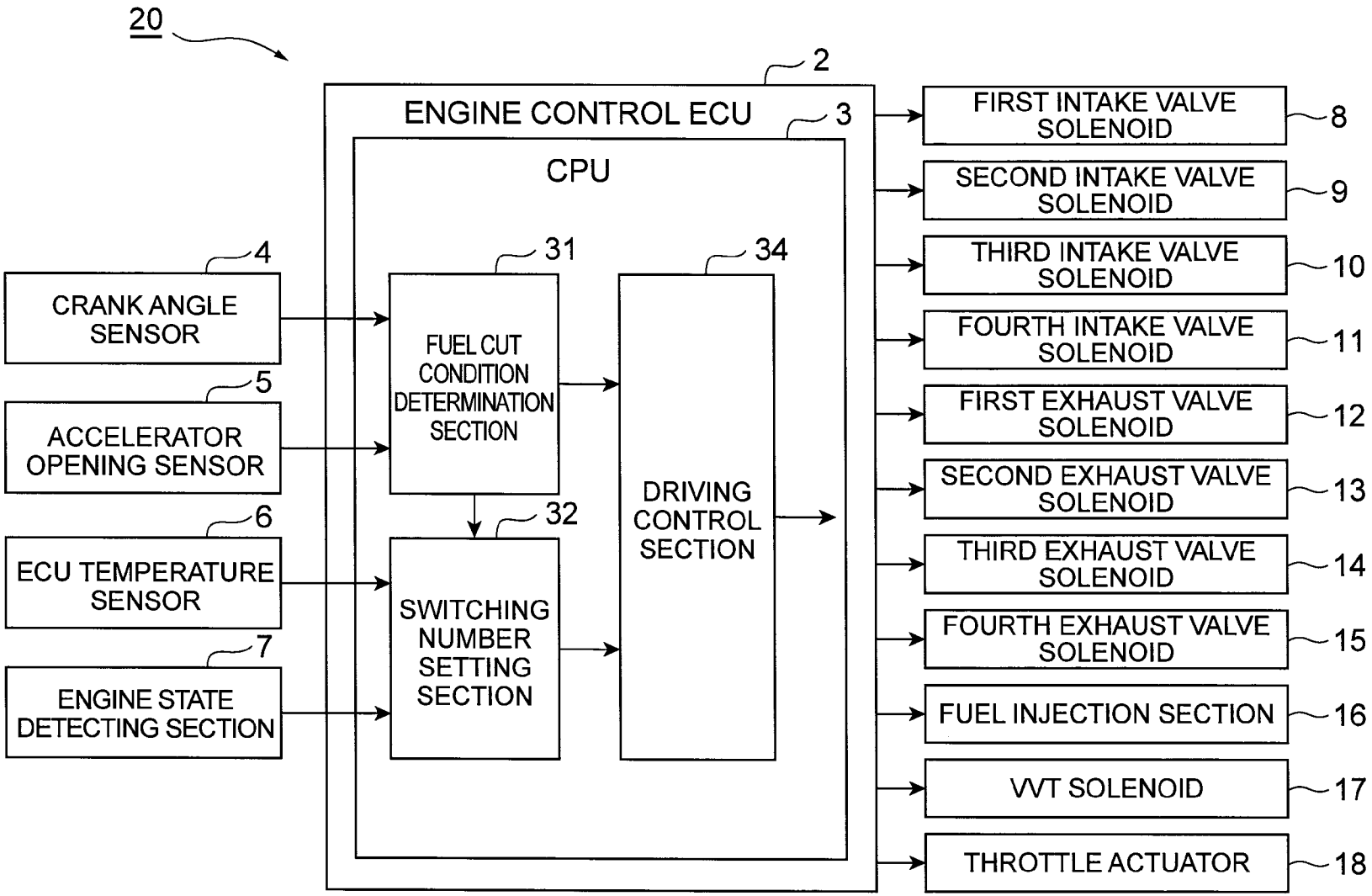
FIG. 3 is a block diagram showing an internal combustion engine control device related to a second embodiment.

As shown in FIG. 2, the internal combustion engine control device 1 first performs detection of various kinds of information using the various sensors 4 to 7 (S1). Next, the fuel cut condition determination section 31 of the internal combustion engine control device 1 determines whether or not predetermined fuel cut conditions are satisfied on the basis of the crank angle signal of the crank angle sensor 4 and the accelerator opening signal of the accelerator opening sensor 5 (S2). When it is determined that the fuel cut conditions are not satisfied, the fuel cut condition determination section 31 returns to S1, and repeats again the detection of various kinds of information.

The switching number setting section 32 performs the switching number setting processing of setting the number of valve elements whose operating state is switched at one time, on the basis of the ECU temperature signal of the ECU temperature sensor 6 and the engine state signal of the engine state detecting section 7, when the fuel cut condition determination section 31 determines that the fuel cut conditions have been satisfied (S3). The switching number setting section 32 sets the number of valve elements whose operating state is switched at one time to be smaller, as the temperature of the engine control ECU 2 recognized from the ECU temperature signal of the ECU temperature sensor 6 is higher.

In S4, the driving control section 33 performs the switching processing and the fuel supply stop processing. The driving control section 33 repeats the switching processing a required number of times, thereby switching the operating state of all the valve elements. The driving control section 33 performs the fuel supply stop processing of stopping fuel supply of all the cylinders after the operating state of all the valve elements is switched, thereby implementing the fuel cut control. Thereafter, the driving control section 33 continues the fuel cut control until the fuel cut condition determination section 31 determines that the fuel cut conditions are not satisfied.

According to the internal combustion engine control device 1 related to the first embodiment described above, as the temperature of the engine control ECU 2 becomes a higher temperature, the number of valve elements whose operating state is switched at one time by the intake valve solenoids 8 to 11 and the exhaust valve solenoids 12 to 15 decreases. Therefore, the electric load applied to the engine control ECU 2 by one switching can be reduced. As a result, since the amount of heat generation of the engine control ECU 2 produced by one switching becomes small, a rise in the temperature of the engine control ECU 2 can be suppressed. Moreover, in this internal combustion engine control device 1, a rise in the temperature of the engine control ECU 2 is suppressed by making the number of valve elements whose operating state is switched at one time small. Thus, realization of the fuel cut control is not hindered. Accordingly, according to this internal combustion engine control device 1, suppression of a rise in the temperature of the engine control ECU 2 and the fuel cut control of the internal combustion engine can be made compatible with each other.

In this way, according to the internal combustion engine control device 1, a rise in the temperature of the engine control ECU 2 can be suppressed in the fuel cut control which is carried out at a relatively high frequency for improvement in fuel consumption. Thus, occurrence of a failure of the engine control ECU 2 caused by a rise in temperature can be favorably prevented. As a result, according to this internal combustion engine control device 1, it is possible to reduce cooling parts acting as measures against heat generation of the engine control ECU 2. Thus, miniaturization and low cost of the engine control ECU 2 can be achieved.

Additionally, the respective processes in the internal combustion engine control device 1 related to the first embodiment are not limited to the above-described aspect.

For example, there may be adopted an aspect in which, when the number of valve elements set in the switching number setting processing is equal to or more than the number (four or more) of intake valves of all the cylinders, the driving control section 33 of engine control ECU 2 may control the intake valve solenoids 8 to 11 and the exhaust valve solenoids 12 to 15 so as to switch the operating state of the valve elements of the intake valves of all the cylinders at one time. In this case, since the operating state of the valve elements of the intake valves of all the cylinders is preferentially switched at one time, it is possible to avoid cases where, at the start of the fuel cut control, unnecessary air enters the cylinders from the intake valves of which the closing is delayed. This improves the execution frequency of instant implementation of the fuel cut control of performing switching of the operating state of the valve elements of the intake valves of all the cylinders and the fuel supply stop of all the cylinders at one time. Accordingly, according to this internal combustion engine control device 1, improvement in the fuel consumption of the engine can be achieved by improving the execution frequency of instant implementation of the fuel cut control.

Additionally, there may be adopted an aspect in which the switching number setting section 32 makes the number of valve elements whose operating state is switched at one time gradually smaller not according to two alternatives of eight and four but according to the temperature or the like of the engine control ECU 2. Additionally, the switching number setting section 32 does not necessarily set the number of valve elements in units of two such that the operating state of valve elements of the intake valve and exhaust valve of one cylinder are switched at one time, and may set the number of valve elements in units of one, in units of three, in units of four, or the like.

Second Embodiment

When an internal combustion engine control device 20 related to a second embodiment is compared to the internal combustion engine control device 1 related to the first embodiment, this device is mainly different in terms of including a VVT (Variable Valve Timing) solenoid 17 and the throttle actuator 18, and in terms of the function of the driving control section 34.

The VVT solenoid 17 is an actuator which drives a variable valve mechanism included in the engine of a vehicle, thereby switching the opening and closing timing or the like of the intake valves and the exhaust valves of cylinders. The VVT solenoid 17 switches the opening and closing timing or the like of the intake valves and exhaust valves of the cylinders, according to a signal from the engine control ECU 2. The throttle actuator 18 is an actuator which opens and closes a throttle valve of the engine. The throttle actuator 18 opens and closes the throttle valve according to a signal from the engine control ECU 2.

The driving control section 34 related to the second embodiment performs internal EGR processing, when the number of valve elements which is set in the switching number setting processing by the switching number setting section 32 and whose operating state is switched at one time is less than the number of all the valve elements of all the cylinders (less than eight). The internal EGR processing is the processing of switching the opening and closing timing or the like of the intake valves and exhaust valves so that the time of valve overlap becomes long, using the VVT solenoid 17, and closing the throttle valve completely, using the throttle actuator 18, thereby increasing the amount of exhaust gas sent to the intake side of the cylinders by EGR.

The driving control section 34 performs simultaneously the switching processing of switching the operating state of the number of valve elements set in the switching number setting processing at one time and the fuel supply stop processing of stopping the fuel supply of all the cylinders, along with the internal EGR processing.

Next, the fuel cut control of the internal combustion engine control device 20 related to the second embodiment will be described with reference to FIG. 4.

Figure 4:
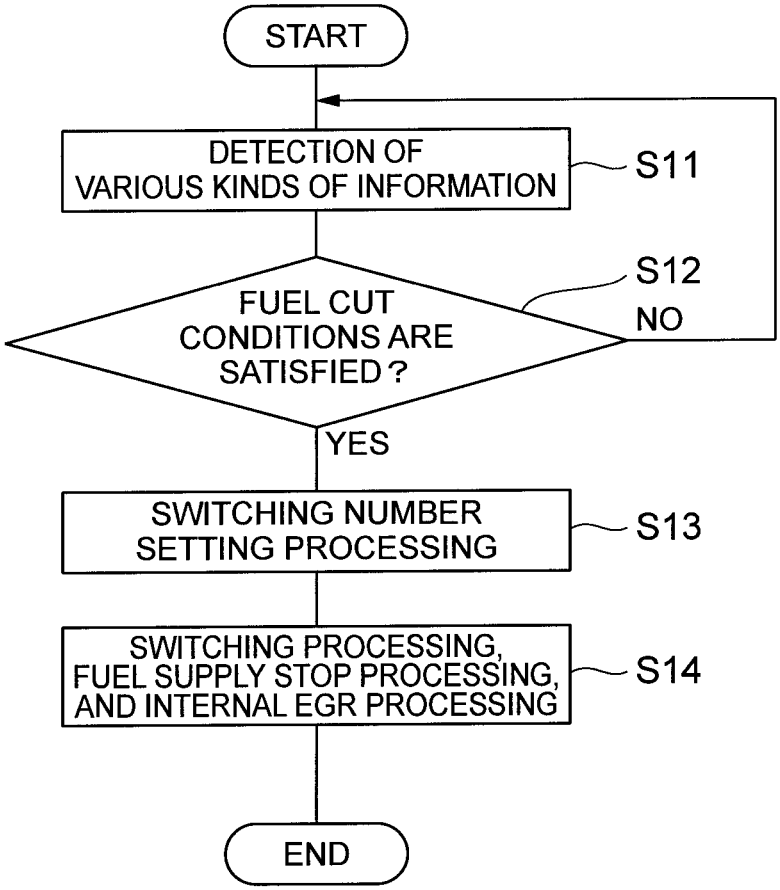
FIG. 4 is a flow chart showing fuel cut control of the internal combustion engine control device related to the second embodiment.

As shown in FIG. 4, the internal combustion engine control device 20 first performs detection of various kinds of information using the various sensors 4 to 7 (S11). Next, the fuel cut condition determination section 31 of the internal combustion engine control device 20 determines whether or not predetermined fuel cut conditions are satisfied on the basis of the crank angle signal of the crank angle sensor 4 and the accelerator opening signal of the accelerator opening sensor 5 (S12). When it is determined that the fuel cut conditions have become not satisfied, the fuel cut condition determination section 31 returns to S11, and repeats again the detection of various kinds of information.

The switching number setting section 32 performs the switching number setting processing of setting the number of valve elements whose operating state is switched at one time, on the basis of the ECU temperature signal of the ECU temperature sensor 6 and the engine state signal of the engine state detecting section 7, when the fuel cut condition determination section 31 determines that the fuel cut conditions have been satisfied (S13). The switching number setting section 32 sets the number of valve elements whose operating state is switched at one time to be smaller, as the temperature of the engine control ECU 2 recognized from the ECU temperature signal of the ECU temperature sensor 6 is higher.

In S14, the driving control section 34 performs the switching processing and the fuel supply stop processing. When the number of valve elements which is set in the switching number setting processing by the switching number setting section 32 and whose operating state is switched at one time is equal to the number of all the valve elements of all the cylinders, the driving control section 34 performs the switching processing and fuel supply stop processing of all the valve elements at one time, thereby implementing the fuel cut control instantly.

Additionally, the driving control section 34 performs the internal EGR processing along with the switching processing and the fuel supply stop processing in S14, when the number of valve elements which is set in the switching number setting processing by the switching number setting section 32 and whose operating state is switched at one time is less than the number of all the valve elements of all the cylinders (less than eight).

At this time, the driving control section 34 performs simultaneously the switching processing of switching the operating state of the number of valve elements set in the switching number setting processing at one time and the fuel supply stop processing of stopping the fuel supply of all the cylinders, thereby implementing the fuel cut control instantly. Thereafter, the driving control section 34 repeats switching processing of the remaining valve elements whose operating state is not switched. The driving control section 33 continues the fuel cut control until the fuel cut condition determination section 31 determines that the fuel cut conditions are not satisfied.

According to the internal combustion engine control device 20 related to the second embodiment described above, the amount of exhaust gas sent to the intake side of the cylinders through EGR by the internal EGR processing can be increased. Thus, even if instant implementation of the fuel cut control is performed, the amount of air which enters the cylinders from the intake valves of which the closing is delayed can be reduced. As a result, the air which has entered the cylinders can be kept from reaching a catalytic device for purifying exhaust gas, causing degradation of a catalyst. Accordingly, according to the internal combustion engine control device 20 related to this second embodiment, degradation of a catalyst can be suppressed while realizing suppression of a rise in the temperature of the engine control ECU 2, and instant implementation of the fuel cut control.

The invention is not limited to the above-described embodiments. For example, the internal combustion engine controlled by the internal combustion engine control device of the invention is not limited to a 4-cylinder reciprocating engine, and may be an engine including a plurality of cylinders having intake valves and exhaust valves.

INDUSTRIAL APPLICABILITY

The invention may be used in an internal combustion engine control device which controls an internal combustion engine.

REFERENCE SIGNS LIST

1, 20: INTERNAL COMBUSTION ENGINE CONTROL DEVICE
2: ENGINE CONTROL ECU
4: CRANK ANGLE SENSOR
5: ACCELERATOR OPENING SENSOR
6: TEMPERATURE SENSOR
7: ENGINE STATE DETECTING SECTION
8: FIRST INTAKE VALVE SOLENOID
9: SECOND INTAKE VALVE SOLENOID
10: THIRD INTAKE VALVE SOLENOID
11: FOURTH INTAKE VALVE SOLENOID
12: FIRST EXHAUST VALVE SOLENOID
13: SECOND EXHAUST VALVE SOLENOID
14: THIRD EXHAUST VALVE SOLENOID
15: FOURTH EXHAUST VALVE SOLENOID
16: FUEL INJECTION SECTION
17: VVT SOLENOID
18: THROTTLE ACTUATOR
31: FUEL CUT CONDITION DETERMINATION SECTION
32: SWITCHING NUMBER SETTING SECTION
33, 34: DRIVING CONTROL SECTION

The invention claimed is:

1. An internal combustion engine control device which controls an internal combustion engine having a plurality of cylinders having intake valves and exhaust valves, the internal combustion engine control device comprising:

switching units which switch the operating state of valve elements of the intake valves or exhaust valves to a drive state and a closed valve holding state;

a control unit which controls the switching units;

a temperature detecting unit which detects the temperature of the control unit; and a switching number setting unit which sets the number of valve elements whose operating state is switched at one time by the switching units to be smaller, as the temperature detected by the temperature detecting unit is higher.

2. The internal combustion engine control device according to claim 1, wherein, when the number of valve elements set by the switching number setting unit is equal to or more than the number of the intake valves of all the cylinders, the control unit controls the switching units such that the operating states of the valve elements of the intake valves of all the cylinders are switched at one time.

* * * * *